US010741972B2

(12) United States Patent
Iwamoto et al.

(10) Patent No.: US 10,741,972 B2
(45) Date of Patent: Aug. 11, 2020

(54) CONNECTOR INCLUDING SHIELD CASE, BODY, AND COVER PORTION FOR IMPROVED ELECTROMAGNETIC COMPATIBILITY

(71) Applicant: HOSIDEN CORPORATION, Yao-shi, Osaka (JP)

(72) Inventors: Yuta Iwamoto, Yao (JP); Hayato Kondo, Yao (JP)

(73) Assignee: HOSIDEN CORPORATION, Yao-Shi, Osaka (JP)

( * ) Notice: Subject to any disclaimer, the term of this patent is extended or adjusted under 35 U.S.C. 154(b) by 0 days.

(21) Appl. No.: 16/516,933

(22) Filed: Jul. 19, 2019

(65) Prior Publication Data

US 2020/0036140 A1 Jan. 30, 2020

(30) Foreign Application Priority Data

Jul. 30, 2018 (JP) ..... 2018-142470

(51) Int. Cl.
*H01R 9/05* (2006.01)
*H01R 13/6581* (2011.01)
*H01R 13/42* (2006.01)

(52) U.S. Cl.
CPC ..... *H01R 13/6581* (2013.01); *H01R 13/42* (2013.01)

(58) Field of Classification Search
CPC ..... H01R 2103/00; H01R 13/514
(Continued)

(56) References Cited

U.S. PATENT DOCUMENTS 4,598,961 A * 7/1986 Cohen ..... H01R 24/50 439/581
4,846,711 A * 7/1989 Kobler ..... H01R 24/50 439/63

(Continued)

FOREIGN PATENT DOCUMENTS

EP 3086471 A1 10/2016
JP 2007035587 A 2/2007
JP 2012022929 A 2/2012

OTHER PUBLICATIONS

Extended European Search Report for European Application No. EP 19185841.4, published by the European Patent Office (EPO), dated Jan. 27, 2020, including corresponding Communication, 10-page EPO Form 1703, European Search Report, Annex, and Information on Search Strategy.

*Primary Examiner* — Thanh Tam T Le
(74) *Attorney, Agent, or Firm* — Kilyk & Bowersox, P.L.L.C.

(57) ABSTRACT

A connector including a shield case, a body housed in the shield case, at least one terminal held by the body, and a shield cover. The shield case includes a tube extending in a first direction and a pair of walls. The walls are located on one side in the first direction relative to the tube, face each other in a second direction orthogonal to the first direction, and extend to one side in a third direction. The third direction crosses the first and second directions. The body includes a first portion in the tube, and a second portion. The first portion includes a basal portion, which includes an exposed portion exposed to one side in the third direction between the walls. The second portion extends between the walls from the basal portion. The shield cover includes a cover portion disposed between the walls to cover at least part of the exposed portion.

20 Claims, 8 Drawing Sheets

(58) Field of Classification Search
USPC ..... 439/63, 579, 581, 582, 675, 701
See application file for complete search history.

(56) References Cited

U.S. PATENT DOCUMENTS

| | | | | | |
|---|---|---|---|---|---|
| 4,846,719 | A * | 7/1989 | Iwashita | H01R 24/58 | 439/63 |
| 5,011,415 | A * | 4/1991 | Suzuki | H01R 24/50 | 439/581 |
| 5,334,050 | A * | 8/1994 | Andrews | H01R 24/50 | 439/579 |
| 6,116,914 | A * | 9/2000 | Koide | H01R 13/432 | 439/581 |
| 6,520,781 | B2 | 2/2003 | Koide et al. | | |
| 7,029,286 | B2 * | 4/2006 | Hall | H01R 13/506 | 439/357 |
| 7,086,867 | B2 * | 8/2006 | Nakagawa | H01R 24/42 | 439/63 |
| 7,137,825 | B2 * | 11/2006 | Myer | H01R 24/50 | 439/63 |
| 7,458,834 | B1 * | 12/2008 | Chen | H01R 13/11 | 439/188 |
| 8,602,831 | B2 * | 12/2013 | Miyawaki | H01R 43/16 | 439/877 |
| 9,124,047 | B2 * | 9/2015 | Kanda | H01R 13/6474 | |
| 9,812,823 | B2 * | 11/2017 | Kawakami | H01R 12/724 | |
| 10,424,861 | B2 * | 9/2019 | Suzuki | H01R 13/41 | |
| 2013/0115787 | A1 | 5/2013 | Kanda | | |

* cited by examiner

CONNECTOR INCLUDING SHIELD CASE, BODY, AND COVER PORTION FOR IMPROVED ELECTROMAGNETIC COMPATIBILITY

CROSS-REFERENCE TO RELATED APPLICATION

The present application claims priority under 35 U.S.C. § 119 of Japanese Patent Application No. 2018-142470 filed on Jul. 30, 2018, the disclosure of which is expressly incorporated by reference herein in its entirety.

BACKGROUND OF THE INVENTION

Technical Field

The invention relates to connectors.

Background Art

Japanese Unexamined Patent Publication No. 2012-22929 (paragraph 0008 and FIGS. 10 and 11) discloses a conventional connector including a terminal, a body, and a shield case. The terminal is generally L-shaped and has first and second portions perpendicular to each other. The body is generally L-shaped and holds the terminal. The shield case is made of a stamped metal plate and has a tubular portion and a housing portion behind the tubular portion. The body is held by the tubular portion, the first portion of the terminal is disposed in the tubular portion, and the second portion of the terminal is disposed in the housing portion.

SUMMARY OF INVENTION

The housing portion of the shield case includes an upper plate contiguous at its rear end with a bent piece. The bent piece is bent substantially perpendicular to the upper plate to close a rear opening of the housing portion. The front opening of the housing portion opens to the front, however, adversely affecting electromagnetic compatibility (EMC) characteristics of the conventional connector.

It is an object of the invention to provide a connector with improved EMC characteristics.

A connector according to an aspect of the invention includes a shield case being electrically conductive, a body being electrically insulating and housed in the shield case, at least one terminal being held by the body and housed in the shield case, a shield cover being electrically conductive and provided separately from the shield case. The shield case includes a tubular portion extending in a first direction and a pair of walls. The walls are located on one side in the first direction relative to the tubular portion, face each other in a second direction, and extend to one side in a third direction. The first direction is the axial direction of the tubular portion. The second direction is substantially orthogonal to the first direction. The third direction crosses the first and second directions. The body includes a first portion and a second portion. The first portion extends in the first direction, is disposed in the tubular portion, and includes a basal portion positioned on the one side in the first direction relative to the tubular portion. The second portion extends to the one side in the third direction from the basal portion of the first portion and is disposed between the walls of the shield case.

The basal portion may include a first exposed portion exposed to one side in the third direction between the walls.

In this case, the shield cover may preferably include a first cover portion disposed between the walls to cover at least part of the first exposed portion of the first portion of the body from the one side in the third direction.

In the connector of this aspect, the first exposed portion of the basal portion of the first portion of the body is exposed to the one side in the third direction between the walls of the shield case, but at least part of the first exposed portion is covered by the first cover portion from the one side in the third direction. This arrangement improves the EMC characteristics of the connector.

The shield cover may further include at least one first elastic arm provided at the first cover portion. The at least one first elastic arm may be in elastic contact with at least one of the tubular portion, one of the walls, or the other wall of the shield case.

In the connector of this aspect, the elastic contact of the at least one first elastic arm with at least one of the tubular portion, one of the walls, or the other wall of the shield case brings the shield cover into a stable electrical conduction with the shield case. The shield case and the shield cover thus serve to establish a stable ground line.

The second portion may include a second exposed portion exposed to the other side in the first direction between the walls. In this case, the shield cover may preferably include a second cover portion disposed between the walls to cover at least part of the second exposed portion of the second portion of the body from the other side in the first direction.

In the connector of this aspect, the second exposed portion of the second portion of the body is exposed to the other side in the first direction between the walls of the shield case, but at least part of the second exposed portion is covered by the second cover portion from the other side in the first direction. This arrangement improves the EMC characteristics of the connector.

The shield cover may further include at least one second elastic arm provided at the second cover portion. The or each second elastic arm may be in elastic contact with one of the walls.

In the connector of this aspect, the elastic contact of the or each second elastic arm with one of the walls of the shield case brings the shield cover into a stable electrical conduction with the shield case. The shield case and the shield cover thus serve to establish a stable ground line.

The pair of walls may include a first wall and a second wall. A plurality of the second elastic arms may be provided, including one second elastic arm and the other second elastic arm. The one second elastic arm may be inserted between the first wall and the second portion of the body. The other second elastic arm may be inserted between the second wall and the second portion of the body.

In the connector of this aspect, it is possible to insert the one second elastic arms between the first wall and the second portion of the body, and the other second elastic arm between the second wall and the second portion of the body, and also to cover the second exposed portion of the second portion of the body with the second cover portion. In other words, it is possible to almost simultaneously perform two steps of bringing the second elastic arms into elastic contact with the walls and covering the second exposed portion of the second portion of the body with the second cover portion.

The second portion of the body may be provided with a housing recess opening to the other side in the first direction and housing the second cover portion. In this case, the second exposed portion of the second portion may be the bottom of the housing recess. In the connector of this aspect, the second cover portion in is housed in the housing recess of the second portion and therefore resists falling off when covering the second exposed portion of the second portion.

The shield cover may further include at least one attaching portion located between the walls of the shield case. The or each attaching portion may be attached to the second portion of the body and/or one of the walls.

In the connector of this aspect, it is possible to dispose the first or second cover portion between the walls of the shield case, and also to attach the or each attaching portion to the second portion of the body and/or one of the walls. This arrangement facilitates attachment of the at least one attaching portion.

The at least one attaching portion is only required to be attached to at least one of the shield case or the body.

The at least one attaching portion may extend in the first direction. In this case, the or each attaching portion may be inserted between the second portion and one of the walls. The at least one attaching portion may alternatively be received in a receiving groove or a receiving hole provided in the second portion of the body, and may be attached to the second portion.

Each of the walls may be larger in dimension in the first direction than the second portion of the body.

The tubular portion may have a first end on one side in the first direction. The shield case may further include an extended portion. The extended portion may be shaped like a half tube having a generally semi-circular, generally semi-polygonal, generally arc-shaped, or generally U-shaped, cross-section taken along the third direction. The extended portion of the shield case may extend to the one side in the first direction from a portion on the other side in the third direction of the first end of the tubular portion and may include first and second ends respectively on one and the other sides in the second direction. The walls of the shield case may include a first wall and a second wall. The first wall may extend from the first end of the extended portion to the one side in the third direction, and the second wall may extend from the second end of the extended portion to the one side in the third direction.

The shield case may further include a blocking portion. The blocking portion may at least partly block a space inside the extended portion and a space between the first and second walls from the one side in the first direction.

In the connector of this aspect, the extended portion blocks the space between the walls from the other side in the third direction, and the blocking portion at least partly blocks the space inside the extended portion and the space between the walls from the one side in the first direction. This arrangement further improves the EMC characteristics of the connector.

BRIEF DESCRIPTION OF DRAWINGS

The present invention can be even more fully understood with the reference to the accompanying drawings which are intended to illustrate, not limit, the present invention.

DESCRIPTION OF EMBODIMENTS

Figure 1A:
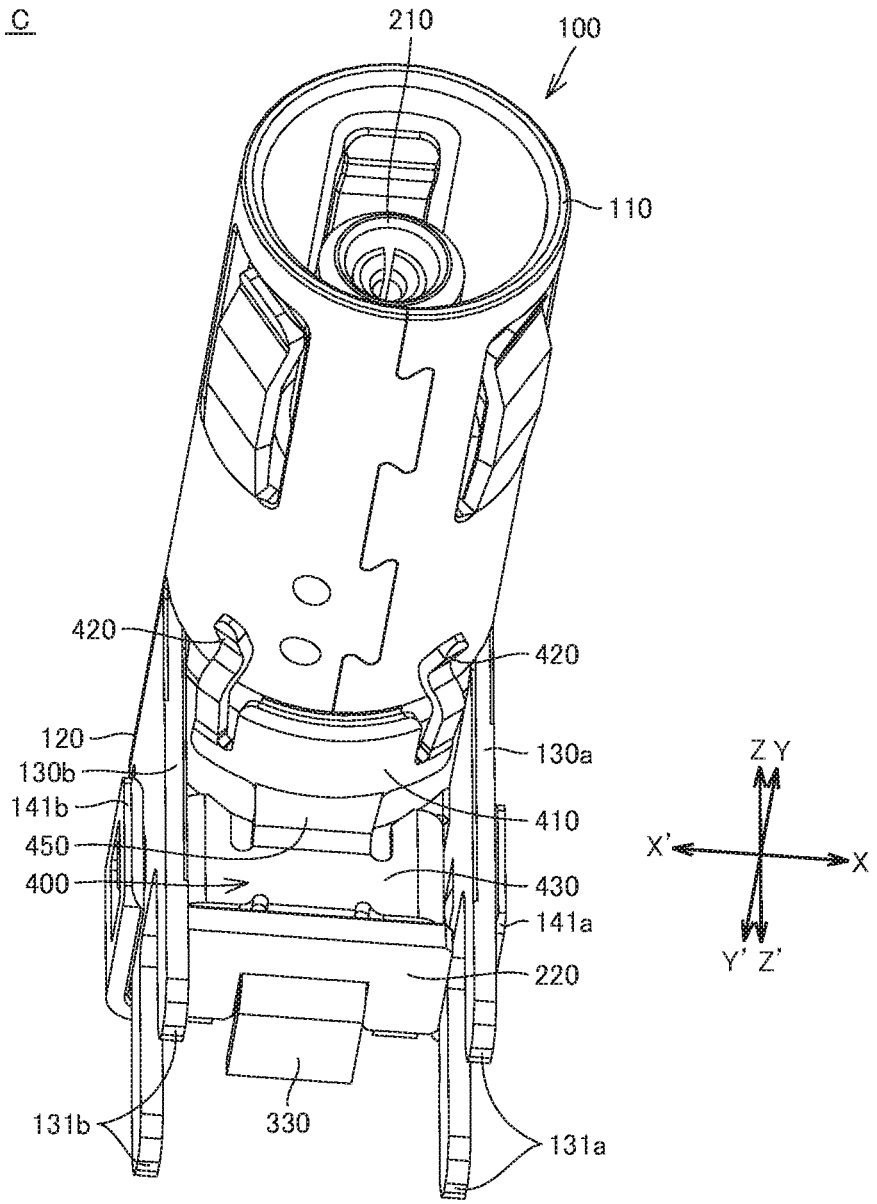
FIG. 1A is a front, bottom, left side perspective view of a connector according to a first embodiment of the invention.
Figure 1B:
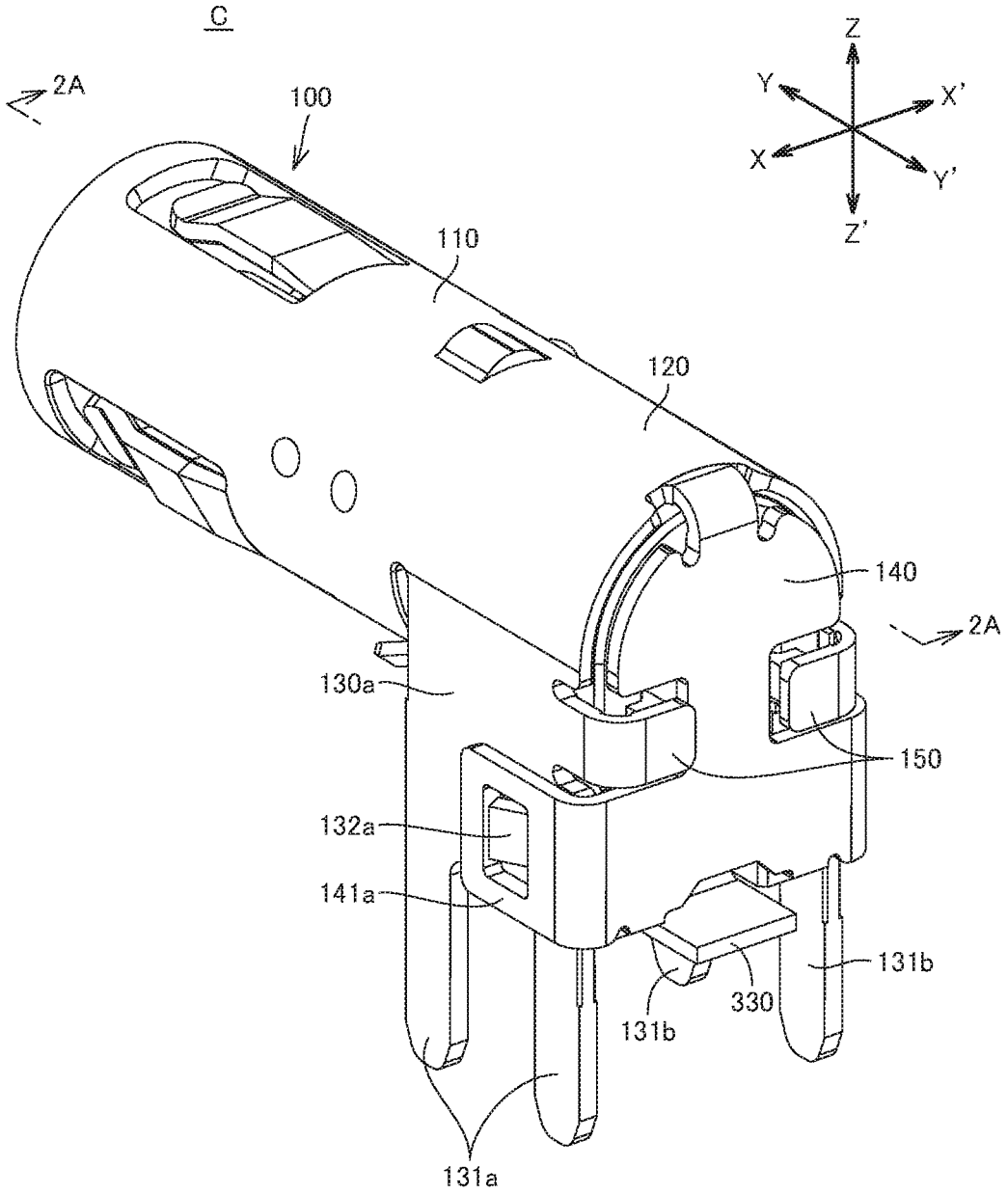
FIG. 1B is a rear, top, right side perspective view of the connector.
Figure 2A:
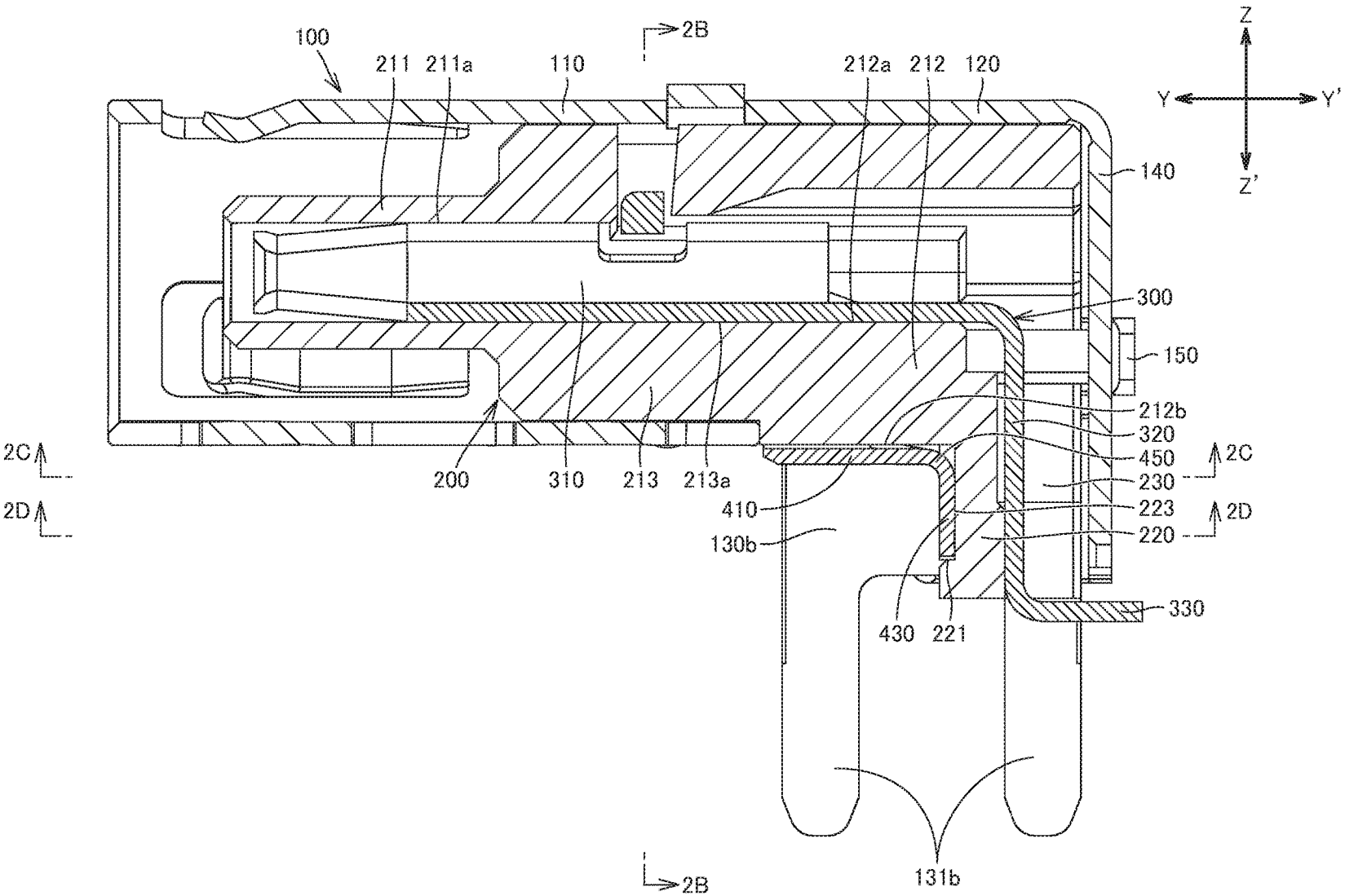
FIG. 2A is a sectional view of the connector, taken along line 2A-2A in FIG. 1A.
Figure 2B:
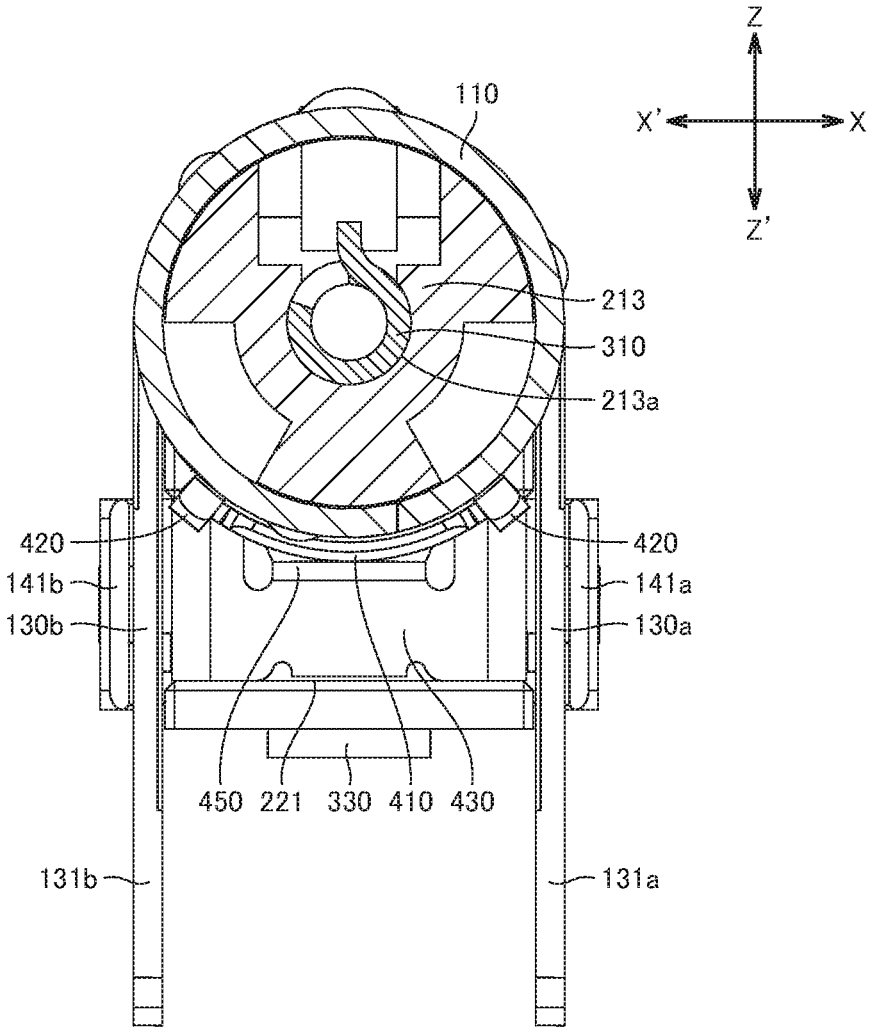
FIG. 2B is a sectional view of the connector, taken along line 2B-2B in FIG. 2A.
Figure 2C:
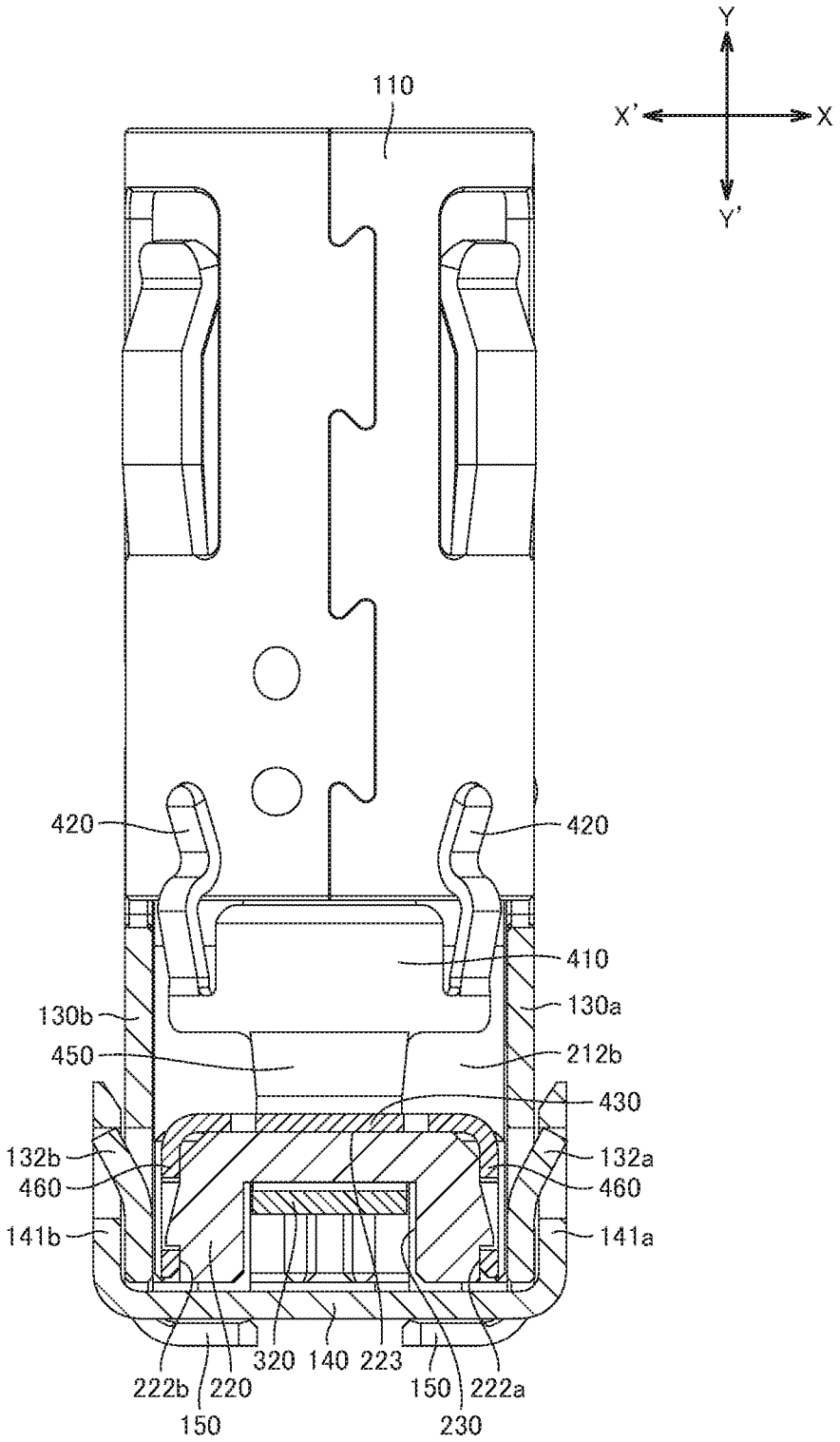
FIG. 2C is a sectional view of the connector, taken along line 2C-2C in FIG. 2A.
Figure 2D:
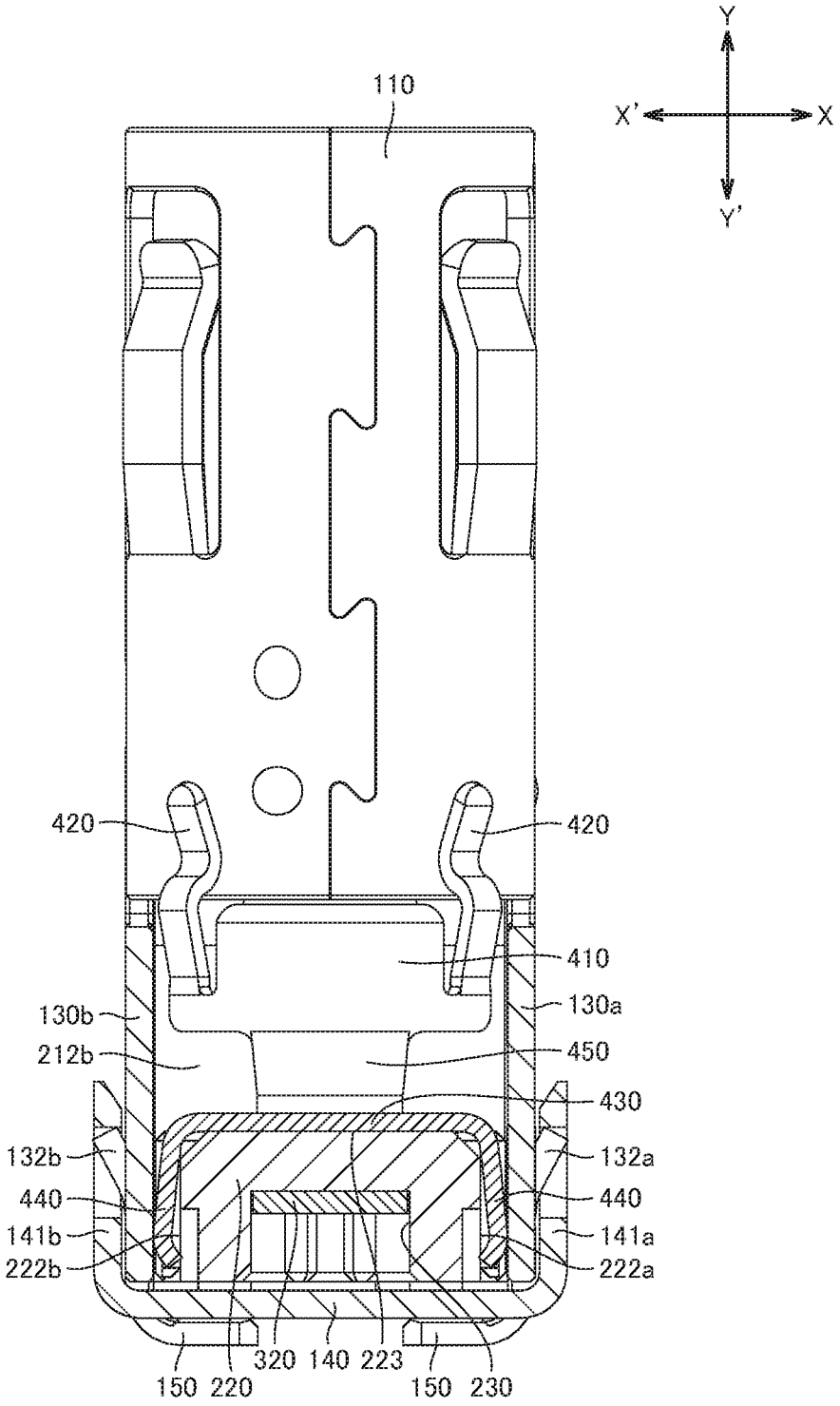
FIG. 2D is a sectional view of the connector, taken along line 2D-2D in FIG. 2A.

The following description is directed to a connector C according to various embodiments, including a first embodiment, of the invention, with reference to FIGS. 1A to 3B. The connector C is mountable on a circuit board (not illustrated). FIGS. 1A to 3B illustrate the connector C of the first embodiment. The Y-Y' direction indicated in FIGS. 1A, 1B, 2A, and 2C to 3B corresponds to the first direction defined in the accompanying claims. In the Y-Y' direction, Y' and Y directions respectively correspond to one and the other side in the first direction. The X-X' direction indicated in FIGS. 1A and 1B, and 2B to 3B is substantially orthogonal to the Y-Y' direction and corresponds to the second direction defined in the accompanying claims. In the X-X' direction, X' and X directions respectively correspond to one and the other side in the second direction. The Z-Z' direction indicated in FIGS. 1A, 1B, 2A, 2B, 3A, and 3B crosses (is at an angle to) the Y-Y' and X-X' directions and corresponds to the third direction defined in the accompanying claims. In the Z-Z' direction, Z' and Z directions respectively correspond to one and the other side in the third direction. As shown in the drawings, the Z-Z' direction may be substantially orthogonal to (cross substantially at right angles to) the Y-Y' and X-X' directions.

The connector C includes a shield case 100 being electrically conductive. The shield case 100 may preferably be, but is not required to be, a pressed metal plate (see FIGS. 1A to 3B). The shield case 100 includes a tubular portion 110, an extended portion 120, and a pair of walls 130*a* and 130*b*.

The tubular portion 110 is a tube extending in Y-Y' direction having a generally circular (as shown FIGS. 1A to 3B) or generally polygonal cross-section taken along the Z-Z' direction. Accordingly, the longitudinal, or axial, direction of the tubular portion 110 is the Y-Y' direction. The tubular portion 110 is open on its Y-direction side. The tubular portion 110 has a first end on the Y'-direction side. The first end is ring-shaped (e.g. generally circular or generally polygonal) and includes a portion on the Z-direction side and a portion on the Z'-direction side. The extended portion 120 extends in the Y' direction from the Z-direction side of the first end of the tubular portion 110. The extended portion 120 has a shape conforming to the portion on the Z-direction side of the first end of the tubular portion 110. More particularly, the extended portion 120 is shaped like a half tube having a generally semi-circular (as shown FIGS. 1A to 3B), generally semi-polygonal, generally arc-shaped, or generally U-shaped, cross-section taken along the Z-Z' direction. The extended portion 120 has an inner space, the Y-direction side of which communicates with a space inside the tubular portion 110, and the Y'-direction side of which is open to the outside. The extended portion 120 includes a first end 121 on the X-direction side, a second end 122 on the X'-direction side, and a third end on the Y'-direction side. It should be noted that as used herein a generally circular shape should be understood as including a generally elliptical or generally oval shape.

The walls 130*a* and 130*b* extend respectively from the first end 121 and the second end 122 of the extended portion 120, in the Z' direction beyond an imaginary line extending in the Y-Y' direction along the end on the Z'-direction side of the tubular portion 110. The walls 130*a* and 130*b* are positioned on the Y'-direction side relative to the tubular portion 110, and they face each other in the X-X' direction. The walls 130*a* and 130*b* respectively correspond to first and second walls defined in the accompanying claims. The wall 130*a*, which is a wall on the X-direction side, includes a first portion, a second portion, an outer face (a face on the X-direction side), and an inner face (a face on the X'-direction side). The wall 130*b*, which is a wall on the X'-direction side, includes a first portion, a second portion, an outer face (a face on the X'-direction side), and an inner face (a face on the X-direction side). The first portions of the walls 130*a* and 130*b* partly abut, or are partly arranged in an opposed spaced relationship to, respective portions on the Z'-direction side of the first end of the tubular portion 110. The second portions of the walls 130*a* and 130*b* are positioned on the Z'-direction side relative to the corresponding first portions of the walls 130*a* and 130*b*, and they are not opposed to the tubular portion 110 in Y-Y' direction. The walls 130*a* and 130*b* define a space, which will be referred to as a "space between the walls 130*a* and 130*b*". The space between the walls 130*a* and 130*b* includes a first space and a second space. The first space is provided between the first portions of the walls 130*a* and 130*b*. The first space communicates on Z-direction side with a space inside the extended portion 120, communicates on Y-direction side with a space inside the tubular portion 110, and opens on its Y'-direction side to the outside. The second space is provided between the second portions of the walls 130*a* and 130*b*. The second space communicates with the first space and opens on the Y-, Y'-, and Z'-direction sides to the outside.

The walls 130*a* and 130*b* are respectively provided with at least one leg portion 131*a* and at least one leg portion 131*b*. In an aspect, the at least one leg portion 131*a* and the at least one leg portion 131*b* extend in the Z' direction from the walls 130*a* and 130*b*, respectively as illustrated in FIGS. 1A to 3B. The or each leg portion 131*a* may be connectable to a corresponding first through-hole electrode (not illustrated) provided in the circuit board. The or each leg portion 131*b* may be connectable to a corresponding second through-hole electrode (not illustrated) provided in the circuit board.

In another aspect, the or each leg portion 131*a* may extend in the X, Y, or Y' direction from the wall 130*a* and may be connectable to a corresponding first surface electrode (not illustrated) of the circuit board, and the or each leg portion 131*b* may extend in X', Y, or Y' direction from the wall 130*b* and may be connectable to a corresponding second surface electrode (not illustrated) of the circuit board.

In yet another aspect, the at least one leg portion 131*a* and the at least one leg portion 131*b* may each be formed by partly cutting and bending the corresponding wall 130*a* or 130*b*. Also in this aspect, the or each leg portion 131*a* may be connectable to a corresponding first surface electrode (not illustrated) of the circuit board, and the or each leg portion 131*b* may be connectable to a corresponding second surface electrode (not illustrated) of the circuit board.

The leg portions 131*a* and 131*b* are preferably grounded when connected to the first and second through-hole electrodes or the first and second surface electrodes.

The shield case 100 may further include a blocking portion 140. As illustrated in FIGS. 1 to 3B, the blocking portion 140 may be a plate connected to the third end of the extended portion 120. The blocking portion 140 is bent at an angle of approximately 90° to the extended portion 120, and at least partly blocks the space inside the extended portion 120 and the space between the walls 130*a* and 130*b* from the Y'-direction side. In this case, the blocking portion 140 may include engaging portions 141*a* and 141*b*, respectively, and the walls 130*a* and 130*b* may respectively include engaging portions 132*a* and 132*b*, respectively. The engaging portions 141*a* and 141*b* include plates extending in the Y direction respectively from the ends on the X- and X'-direction sides of the blocking portion 140 and abutting the respective outer faces of the walls 130*a* and 130*b*. The plates of the engaging portions 141*a* and 141*b* may be provided with respective engaging projections, and the engaging portions 132*a* and 132*b* may be provided with respective engaging holes. Alternatively, the plates of the engaging portions 141*a* and 141*b* may be provided with respective engaging holes, and the engaging portions 132*a* and 132*b* may be provided with respective engaging projections. In either case, when the engaging projections are engaged with the respective engaging holes, the blocking portion 140 is secured to the walls 130*a* and 130*b*.

In another aspect, the blocking portion 140 may be a plate contiguous with one of the walls 130*a* or 130*b*. The blocking portion 140 in this aspect is bent at an angle of approximately 90° with respect to the one of the walls 130*a* or 130*b*, and at least partly blocks the space inside the extended portion 120 and the space between the walls 130*a* and 130*b* from the Y'-direction side. In this case, the blocking portion 140 may have the engaging portion 141*a* or 141*b*, and the other wall may have the engaging portion 132*a* or 132*b*.

In yet another aspect, the blocking portion 140 may be provided separately from the shield case 100. The blocking portion 140 in this aspect at least partly blocks the space inside the extended portion 120 and the space between the walls 130*a* and 130*b* from the Y'-direction side. In this case, the blocking portion 140 may have the engaging portions 141*a* and 141*b*, and the walls 130*a* and 130*b* may have the engaging portions 132*a* and 132*b*, respectively.

The blocking portion 140 may be omitted. In any of the above aspects, it is possible to omit the engaging portions 141*a* and 141*b* and the engaging portions 132*a* and 132*b*.

The shield case 100 may further include at least one abutment 150. The at least one abutment 150 is provided on at least one of the walls 130*a* and 130*b*, and is bent at an angle of approximately 90° with respect to the at least one wall, and abuts a body 200 (to be described) of the connector C from the Y'-direction side. Where the shield case 100 includes the blocking portion 140, the blocking portion 140 may be partly cut out so as not to interfere with the at least one abutment 150. The at least one abutment 150 may be omitted.

The connector C further includes the body 200 mentioned above and a terminal 300. The body 200 is electrically insulative and may be made of an insulating resin. The body 200 holds the terminal 300 and is housed in the shield case 100.

Figure 3A:
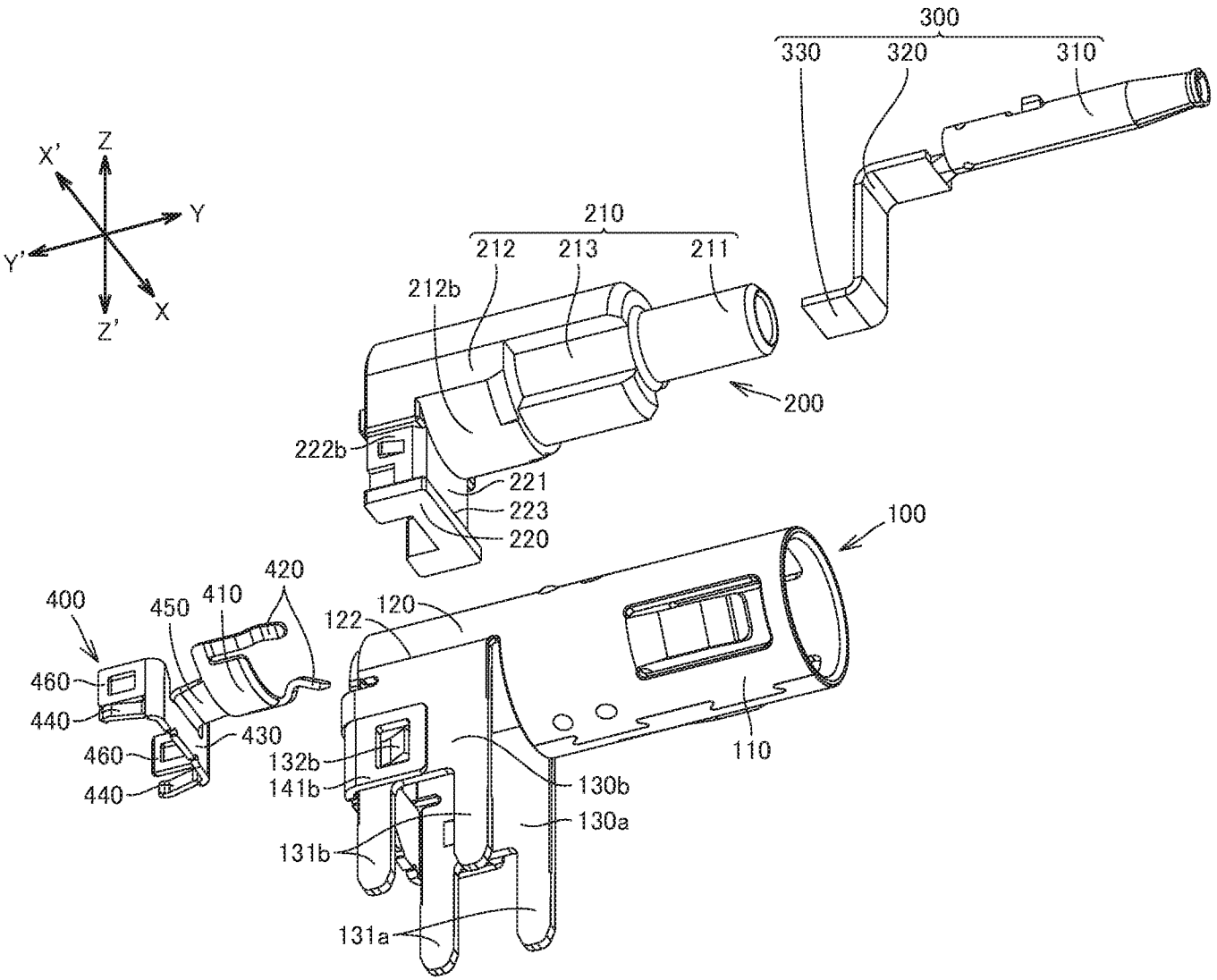
FIG. 3A is an exploded, front bottom left side perspective view of the connector.
Figure 3B:
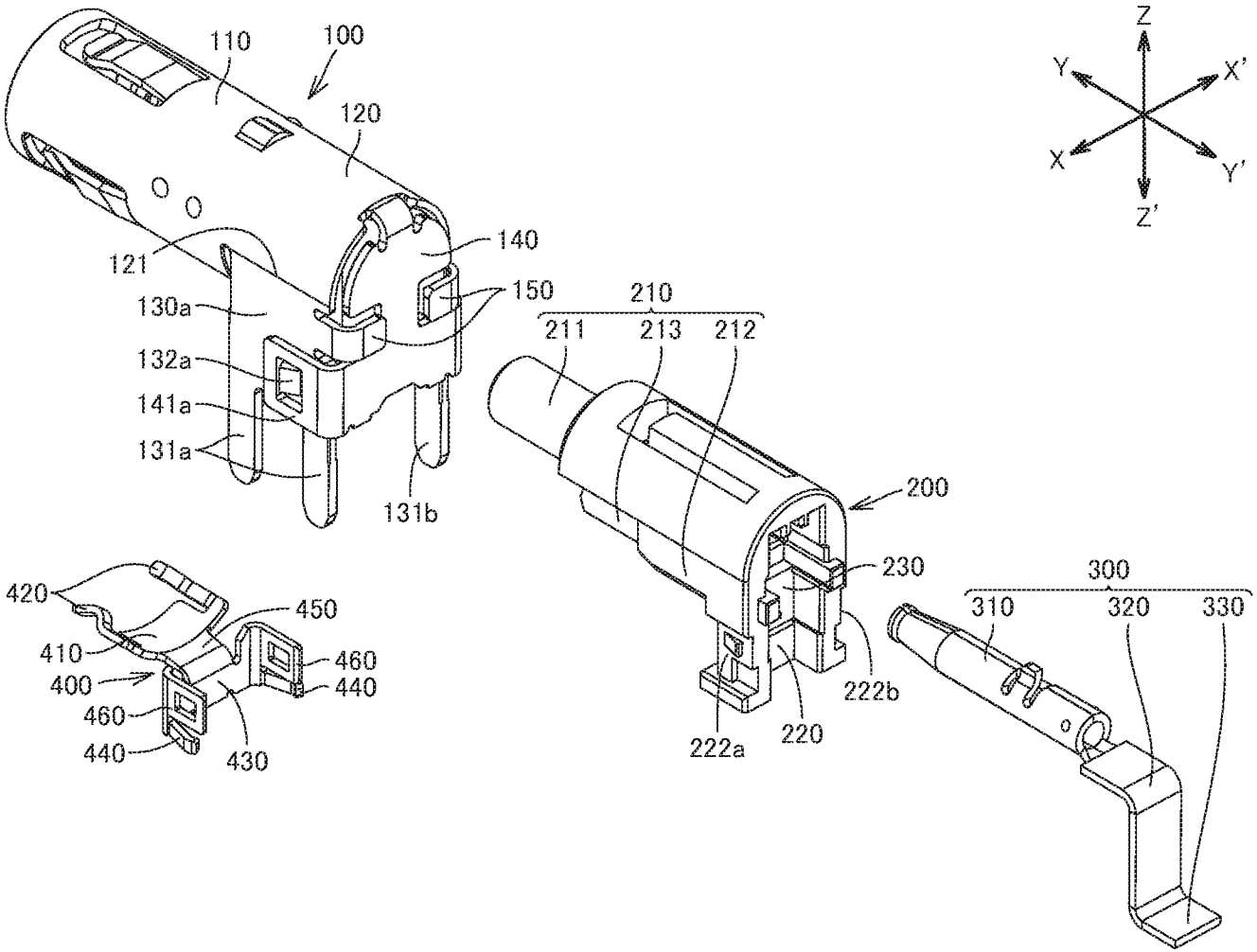
FIG. 3B is an exploded, rear, top, right side perspective view of the connector.

The body 200 includes a first portion 210 extending in the Y-Y' direction and being housed at least in the tubular portion 110 of the shield case 100. The first portion 210 of the body 200 may also be housed in the extended portion 120, and also (in the first space) between the first portions of the walls 130*a* and 130*b*, of the shield case 100. The first portion 210 may include a distal portion 211, a basal portion 212, and an intermediate portion 213 as illustrated in FIGS. 3A and 3B, for example. The intermediate portion 213, located between the distal portion 211 and the basal portion 212 of the body 200, is held inside the tubular portion 110. The intermediate portion 213 accordingly has outer dimensions corresponding to the inner dimensions of the tubular portion 110 of the shield case 100. The intermediate portion 213 has a lock hole 213*a* extending in Y-Y' direction.

The distal portion 211 is a tube having a generally circular or generally polygonal cross-section. The distal portion 211 extends in the Y direction from the intermediate portion 213 and is housed in the tubular portion 110 of the shield case 100. The distal portion 211 has a connection hole 211*a* extending in the Y-Y' direction and opens on its Y-direction side to the outside. The connection hole 211*a* is positioned on the Y-direction side relative to the lock hole 213*a* to communicate with the lock hole 213*a*.

The basal portion 212 is a solid block extending in the Y' direction from the intermediate portion 213. The basal portion 212 has a lock groove 212*a* and a first exposed portion 212*b*. The lock groove 212*a* is positioned on the Y'-direction side relative to the lock hole 213*a* and communicates with the lock hole 213*a*. The first exposed portion 212*b* is an outer face on the Z'-direction side of the basal portion 212, positioned on the Y'-direction side relative to the tubular portion 110, and exposed in the Z' direction between the walls 130*a* and 130*b*. The basal portion 212 further includes a coupling portion on the Y'-direction side relative to the first exposed portion 212*b*.

The body 200 further includes a second portion 220. The second portion 220 extends in the Z' direction from the coupling portion of the basal portion 212. The second portion 220 is positioned on the Y'-direction side relative to the first exposed portion 212*b* and disposed (in the second space) between the second portions of the walls 130*a* and 130*b*. The second portion 220 has a dimension in Y-Y' direction smaller than that of each wall 130*a*, 130*b*. A housing groove 230 is provided in the second portion 220 and the basal portion 212 of the first portion 210. The housing groove 230 is positioned on the Y'-direction side relative to the lock groove 212*a*, extends in the Z-Z' direction, communicates with the lock groove 212*a*, and opens in the Y' direction.

The terminal 300 is a metal plate of generally L-shape. The terminal 300 has a contact portion 310, a lead portion 320, and a tail 330. The contact portion 310 is a tube having a generally circular or polygonal cross-section, a plate, or a bar. The contact portion 310 extends in the Y-Y' direction and is housed in the connection hole 211*a* and the lock hole 213*a* of the first portion 210 of the body 200. The lead portion 320 is a plate or a bar of a generally L-shape. The lead portion 320 includes a horizontal portion, which extends in the Y' direction from the Y'-direction end of the contact portion 310, and a vertical portion, which extends in the Z' direction from an end in Y' direction of the horizontal portion. The horizontal portion of the lead portion 320 is housed in the lock groove 212*a*, and the vertical portion of the lead portion 320 is housed in the housing groove 230. In an aspect, the contact portion 310 is held in the lock hole 213*a*, and/or the horizontal portion of the lead portion 320 is held in the lock groove 212*a*. The tail 330, a plate or a bar, extends in the Y' or Z' direction from the Z'-direction end of the lead portion 320. The tail 330 is connectable to a third surface electrode or a third through-hole electrode of the circuit board.

In another aspect, the terminal 300 may be configured as follows. The contact portion 310 of the terminal 300 is held in the first portion 210 of the body 200, and a leading portion of the contact portion 310 is exposed in the Z or Z'-direction from the first portion 210 or projects in the Y direction. The lead portion 320 of the terminal 300 is held in the second portion 220 of the body 200. The tail 330 of the terminal 300 may have a similar configuration to that described above. In accordance with such terminal 300, the body 200 may be configured as follows. The first portion 210 extends in the Y-Y' direction, is housed in the tubular portion 110, in the extended portion 120, and (in the first space) between the first portions of the walls 130*a* and 130*b* of the shield case 100, and is held partly by the tubular portion 110. The first portion 210 at least includes a basal portion 212. The basal portion 212 is disposed in the extended portion 120 and (in the first space) between the first portions of the walls 130*a* and 130*b*. The basal portion 212 includes a first exposed portion 212*b*. The first exposed portion 212*b* is an outer face on the Z'-direction side of the basal portion 212, positioned on the Y'-direction side relative to the tubular portion 110, and exposed in the Z' direction. The coupling portion of the basal portion 212 is configured as described above. The second portion 220 of the body 200 extends in the Z' direction from the coupling portion of the basal portion 212, and is positioned on the Y'-direction side relative to the first exposed portion 212*b*, and is disposed (in the second space) between the second portions of the walls 130*a* and 130*b*. The second portion 220 in this aspect also has a dimension in the Y-Y' direction that is smaller than that of each wall 130*a*, 130*b*.

In any of the above aspects, the terminal 300 and the body 200 are arranged as described in item (a) or (b) below, and the body 200 also has a configuration (c) below.

(a) When the terminal 300 is held in the body 200 and the body 200 is housed in the shield case 100, a portion on the Y-direction side of the contact portion 310 is disposed inside the tubular portion 110 of the shield case 100, and a portion on the Y'-direction side of the contact portion 310 and the lead portion 320 are disposed inside the extended portion 120 and between the walls 130*a* and 130*b* of the shield case 100. In other words, the tubular portion 110 surrounds the portion on the Y-direction side of the contact portion 310 of the terminal 300, and the extended portion 120 is disposed on the Z-direction side relative to the portion on the Y'-direction side of the contact portion 310 and the lead portion 320 of the terminal 300, and the walls 130*a* and 130*b* are disposed on the X- and X'-direction sides, respectively, relative to the portion on the Y'-direction side of the contact portion 310 and the lead portion 320 of the terminal 300.

(b) Alternatively, when the terminal 300 is held in the body 200 and the body 200 is housed in the shield case 100, the contact portion 310 in its entirety is disposed inside the tubular portion 110 of the shield case 100, and the lead portion 320 is disposed inside the extended portion 120 and between the walls 130*a* and 130*b* of the shield case 100. In other words, the tubular portion 110 surrounds the contact portion 310 of the terminal 300, the extended portion 120 is disposed on the Z-direction side relative to the lead portion 320 of the terminal 300, and the walls 130*a* and 130*b* are disposed on the X- and X'-direction sides, respectively, relative to the lead portion 320 of the terminal 300.

(c) The second portion 220 of the body 200 has a face on the Y-direction side. The face on the Y-direction side of the second portion 220 may be provided with a housing recess 221 opening in the Y direction. In this case, the housing recess 221 has a bottom serving as a second exposed portion 223 exposed to the Y-direction side and located between the walls 130*a* and 130*b*. Where the housing recess 221 is omitted, the face on the Y-direction side of the second portion 220 in itself serves as the second exposed portion 223 exposed to the Y-direction side and located between the walls 130*a* and 130*b*.

In either of arrangements (a) and (b), where the shield case 100 includes the blocking portion 140, the blocking portion 140 is disposed on the Y'-direction side relative to the lead portion 320.

The connector C further includes a shield cover 400 being electrically conductive. The shield cover 400 is provided separately from the shield case 100. The shield cover 400 is a pressed metal plate (see FIGS. 1A to 3B) or a cast metal plate.

The shield cover 400 includes at least one of a first cover portion 410 or a second cover portion 430. The first cover portion 410 is a plate extending in the Y-Y' and X-X' directions. The first cover portion 410 is disposed between the walls 130*a* and 130*b* and covers, from the Z'-direction side, at least part of the first exposed portion 212*b* of the first portion 210 of the body 200. The first cover portion 410 may cover the entire first exposed portion 212*b* of the first portion 210 of the body 200 from the Z'-direction side. The first cover portion 410 may be in contact with, or in opposing spaced relation to, the first exposed portion 212*b*. The first cover portion 410 may, but is not required to, have a shape conforming to the first exposed portion 212*b*. In FIGS. 1A to 3, the first cover portion 410 curves in an arc shape conforming to the first exposed portion 212*b*. Where the terminal 300 and the body 200 are arranged as described in item (a) above, the first cover portion 410, when covering at least a part of the first exposed portion 212*b* of the first portion 210, is disposed on the Z'-direction side relative to the portion on the Y'-direction side of the contact portion 310 of the terminal 300 and the horizontal portion of the lead portion 320. Where the terminal 300 and the body 200 are arranged as described in item (b) above, the first cover portion 410, when covering at least a part of the first exposed portion 212*b* of the first portion 210, is disposed on the Z'-direction side relative to the horizontal portion of the lead portion 320.

The second cover portion 430 is a plate extending in the X-X' and Z-Z' directions. The second cover portion 430 is disposed between the walls 130*a* and 130*b* and cover at least part of the second exposed portion 223 of the second portion 220 of the body 200 from the Y-direction side. The second cover portion 430 may cover the entire second exposed portion 223 of the second portion 220 of the body 200 from the Y-direction side. The second cover portion 430 may be in contact with, or in opposing spaced relation to, the second exposed portion 223 of the second portion 220. The second cover portion 430 may, but is not required to, have a shape conforming to the second exposed portion 223 of the second portion 220. Where the second portion 220 has the housing recess 221, the second cover portion 430 may preferably be housed in the housing recess 221. When covering at least part of the second exposed portion 223 of the second portion 220 of the body 200, the second cover portion 430 is disposed on the Y-direction side relative to the vertical portion of the lead portion 320 of the terminal 300.

The shield cover 400 may further include a coupling portion 450. The coupling portion 450 is a plate extending from the Y'-direction end of the first cover portion 410 to the Z-direction end of the second cover portion 430. The coupling portion 450 is bent so as to have a generally L-shaped cross-section.

The shield cover 400 may further include at least one first elastic arm 420. The at least one first elastic arm 420 may have one of the following configurations (1) to (4).

(1) As illustrated in FIGS. 1A to 3B, the at least one first elastic arm 420 may extend in the Y direction from the first cover portion 410 to be in elastic contact with an outer face of the tubular portion 110 of the shield case 100 from the Z'-direction side.

(2) The at least one first elastic arm 420 may extend in the Y direction from the first cover portion 410 to be in elastic contact with an inner face of the tubular portion 110 of the shield case 100 from the Z-direction side. In this case, the body 200 may be provided with at least one receiving hole to receive the at least one first elastic arm 420. More particularly, the at least one receiving hole may extend in the Y direction from the first exposed portion 212*b* of the body 200, open in the Z' direction at the first exposed portion 212*b*, and also open toward the inner face of the tubular portion 110.

(3) The at least one first elastic arm 420 may extend in the X direction from the first cover portion 410. The at least one first elastic arm 420 may be in elastic contact, from the X'-direction side, with a portion, on the Y-direction side relative to the body 200, of the inner face of the wall 130*a* of the shield case 100.

(4) The at least one first elastic arm 420 may extend in the X' direction from the first cover portion 410. The at least one first elastic arm 420 may be in elastic contact with, from the X-direction side, with a portion, on the Y-direction side relative to the body 200, of the inner face of the wall 130*b* of the shield case 100.

Where a plurality of the first elastic arms 420 is provided, each of them may have any one of the above configurations (1) to (4). In the embodiment shown in FIGS. 1A to 3B, the shield cover 400 includes a pair of first elastic arms 420 having configuration (1) above.

The shield cover 400 may further include a plurality of second elastic arms 440, which may include at least, one and the other second elastic arms 440. The one s and the other second elastic arms 440 may have configuration (A) or (B) below, for example.

(A) As illustrated in FIGS. 1A to 3B, the one and other second elastic arms 440 extend in the Y' direction, respectively from the X- and X'-direction ends of the second cover portion 430. The one second elastic arm 440 is inserted between the wall 130*a* of the shield case 100 and the second portion 220 of the body 200 and is in elastic contact with the inner face of the wall 130*a* of the shield case 100 from the X'-direction side. The other second elastic arm 440 is inserted between the wall 130*b* of the shield case 100 and the second portion 220 of the body 200 and is in elastic contact with the inner face of the wall 130*b* of the shield case 100 from the X-direction side.

In this case, the X- and X'-direction ends of the second portion 220 of the body 200 may be provided with receiving grooves 222*a* and 222*b*, respectively. The receiving grooves 222*a* and 222*b* are adapted to receive the one and other second elastic arms 440, respectively. Where the second portion 220 is provided with the housing recess 221, the receiving grooves 222*a* and 222*b* may preferably, but are not required to, extend in the Y' direction from the bottom (the face facing in the Y direction) of the housing recess 221. The receiving groove 222*a* opens in Y direction and also toward the inner face of the wall 130*a*. The receiving groove 222*b* opens in the Y direction and also toward the inner face of the wall 130*b*. Where the second portion 220 is not provided with the housing recess 221, the receiving grooves 222*a* and 222*b* may extend in the Y' direction from the face on the Y-direction side of the second portion 220. The receiving grooves 222*a* and 222*b* may be replaced with interstices between the respective walls 130*a* and 130*b* and the second portion 220 of the body 200, the interstices may be adapted to respectively receive the one and other second elastic arms 440.

(B) The one and other second elastic arms 440 may extend in the X and X' directions, respectively from the second cover portion 430 to be in elastic contact respectively with the inner faces of the walls 130*a* and 130*b* of the shield case 100 from the X'- and X-direction sides, respectively.

The shield cover 400 may further include attaching portions 460. The attaching portions 460 may be provided at the first cover portion 410 or the second cover portion 430, and may be attached to at least one of the shield case 100 or the body 200. The attaching portions may preferably include one and the other attaching portions 460. The one and other attaching portions 460 may have configuration (a) or (b) below, for example.

(a) The one and other attaching portions 460 extend in the Y' direction, respectively from the X- and X'-direction ends of the first cover portion 410 or the second cover portion 430 (see FIGS. 1A to 3B). The one attaching portion 460 is inserted between the wall 130*a* of the shield case 100 and an end face on the X-direction side of the second portion 220 of the body 200. One of the one attaching portion 460 and the end face on the X-direction side of the second portion 220 is provided with an engaging projection, the other is provided with an engaging hole, and the engaging projection is engaged is the engaging hole, so that the one attaching portion 460 is attached to the end face on the X-direction side of the second portion 220. The other attaching portion 460 is inserted between the wall 130*b* of the shield case 100 and the end face on the X'-direction side of the second portion 220 of the body 200. One of the other attaching portion 460 and the end face on the X'-direction of the second portion 220 is provided with an engaging projection, the other is provided with an engaging hole, and the engaging projection is engaged in the engaging hole, so that the other attaching portion 460 is attached to the end face on the X'-direction of the second portion 220.

(b) The one and other attaching portions 460 extend in the Y' direction, respectively from the X- and X'-direction ends of the first cover portion 410 or the second cover portion 430. The one attaching portion 460 is inserted between the wall 130*a* of the shield case 100 and the end face on the X-direction side of the second portion 220 of the body 200. One of the one attaching portion 460 and the wall 130*a* is provided with an engaging projection, the other is provided with an engaging hole, and the engaging projection is engaged in the engaging hole, so that the one attaching portion 460 is attached to the wall 130*a*. The other attaching portion 460 is inserted between the wall 130*b* of the shield case 100 and the end face on the X'-direction side of the second portion 220 of the body 200. One of the other attaching portion 460 and the wall 130*b* is provided with an engaging projection, the other is provided with an engaging hole, and the engaging projection is engaged in the engaging hole, so that the other attaching portion 460 is attached to the wall 130*b*.

With either configuration (a) or (b), the receiving groove 222*a* may be provided between the end face on the X-direction side of the second portion 220 and the wall 130*a* so as to receive the one attaching portion 460, the receiving groove 222*b* may be provided between the end face on the X'-direction side of the second portion 220 and 130*b* so as to receive the other attaching portion 460. Also, the interstices mentioned above may be provided, one of which may be located between the end face on the X-direction side of the second portion 220 and the wall 130*a* so as to receive the one attaching portion 460, and the other interstice may be located between the end face on the X'-direction side of the second portion 220 and the wall 130*b* so as to receive the other attaching portion 460. With configuration (a), it is preferable that the bottom of each of the receiving grooves 222*a* and 222*b* respectively be provided with the engaging projection or the engaging hole.

(c) The one and other attaching portions 460 extend in the Y' direction, respectively from the X- and X'-direction ends of the first cover portion 410 or the second cover portion 430. The second portion 220 of the body 200 may have a pair of receiving holes spaced from each other in the X-X' direction, and the receiving holes may fittingly receive the one and other attaching portions 460. The receiving holes open in the Y direction only, or in the Y and Y' directions.

(d) The one and other attaching portions 460 may extend in the X and X' directions, respectively, from the first cover portion 410 or the second cover portion 430. The walls 130*a* and 130*b* of the shield case 100 may be provided with respective fitting holes to fittingly receive the one and other attaching portions 460, respectively.

(e) The one and other attaching portions 460 extend in the X and X' directions, respectively, from the first cover portion 410 or the second cover portion 430. The one and other attaching portions 460 are fixed to the walls 130*a* and 130*b*, respectively, of the shield case 100 with solder or a conductive adhesive.

The one attaching portion 460 of any of the above aspects and the one second elastic arm 440 of any of the above aspects may be provided in spaced relation to each other in the Z-Z' direction, at the X-direction end of the second cover portion 430, and the other attaching portion 460 of any of the above aspects and the other second elastic arm 440 of any of the above aspects may be provided in spaced relation to each other in the Z-Z' direction, at the X'-direction end of the second cover portion 430 (see FIGS. 1A to 3B).

The shield cover 400 may be modified as follows. Where the shield cover 400 includes the first cover portion 410, it is possible to omit the at least one first elastic arm 420, the second cover portion 430, the second elastic arms 440, the coupling portion 450, and/or the attaching portions 460. Where the shield cover 400 includes the second cover portion 430, it is possible to omit the first cover portion 410, the at least one first elastic arm 420, the second elastic arms 440, the coupling portion 450, and/or the attaching portions 460. Where the shield cover 400 includes both the first cover portion 410 and the second cover portion 430 but not the coupling portion 450, it is preferable that the first cover portion 410 and the second cover portion 430 are provided separately from each other. Where the attaching portion 460 is omitted, the first cover portion 410 may be bonded, with an adhesive or the like, to the first exposed portion 212*b* of the first portion 210 of the body 200 or to the tubular portion 110 of the shield cover 400, and/or the second cover portion 430 may be bonded, with an adhesive or the like, to the second exposed portion 223 of the second portion 220 of the body 200 or to the walls 130*a* and 130*b* of the shield cover 400. Alternatively, the second cover portion 430 may be fittingly received in the housing recess 221 so as to be attached to the second portion 220 of the body 200.

The following discussion is directed to methods for manufacturing the connector C according to some of the aspects described above. First, the terminal 300 and the body 200 holding the terminal 300 are prepared. The shield case 100 is also prepared. The first portion 210 and the second portion 220 of the body 200 are placed into the shield case 100. More particularly, the first portion 210 is placed into the tubular portion 110, the extended portion 120, and (into the first space) between the first portions of the walls 130*a* and 130*b* of the shield case 100, while the second portion 220 is placed (into the second space) between the second portions the walls 130*a* and 130*b* of the shield case 100. As a result, the terminal 300 held by the body 200 is set into place. More particularly, depending on the aspect of the connector C, the portion on the Y-direction side of the contact portion 310 of the terminal 300 is disposed inside the tubular portion 110 of the shield case 100, and the portion on the Y'-direction side of the contact portion 310 and the lead portion 320 are disposed inside the extended portion 120 of the shield case 100 and into the space between the walls 130*a* and 130*b*; or alternatively, the entire contact portion 310 of the terminal 300 is disposed inside the tubular portion 110 of the shield case 100, and the lead portion 320 is disposed in the extended portion 120 of the shield case 100 and into the space between the walls 130*a* and 130*b*.

Where the shield case 100 includes the blocking portion 140, the blocking portion 140 is bent at an angle of approximately 90° with respect to the extended portion 120, or with respect to one of the walls 130*a* and 130*b*. As a result, the blocking portion 140 at least partly blocks the space inside the extended portion 120 and the space between the walls 130*a* and 130*b* from the Y'-direction side, and is disposed on the Y'-direction side relative to the lead portion 320. Alternatively, where the blocking portion 140 is provided separately from the shield case 100, the blocking portion 140 is attached to the shield case 100 so as to at least partly block the space inside the extended portion 120 and the space between the walls 130*a* and 130*b* from the Y'-direction side and to be disposed on the Y'-direction side relative to the lead portion 320. Where the shield case 100 includes the at least one abutment 150, the or each abutment 150 is bent at an angle of approximately 90° with respect to the corresponding wall of the shield case 100 so as to be brought into contact with the body 200. Such step of bending the at least one abutment 150, if included, may be performed before or after the step of bending or attaching the blocking portion 140.

The shield cover 400 is also prepared and attached to the shield case 100 or the body 200. For the purpose of description and not of limitation, the following alternative steps (i) to (iv) of attaching the shield cover 400 relate to only some of the above-described various aspects of the shield cover 400.

(i) Where the shield cover 400 prepared includes the second cover portion 430, the one and other second elastic arms 440 of configuration (A) described above, and the one and other attaching portions 460 of the configuration (a) or (b) described above: The one attaching portion 460 and the one second elastic arm 440 are inserted between the second portion 220 of the body 200 and the wall 130*a* from the Y-direction side, and the other attaching portion 460 and the other second elastic arm 440 are inserted between the second portion 220 of the body 200 and the wall 130*b* from the Y-direction side. The one attaching portion 460 inserted is fixed onto the end face on the X-direction side of the second portion 220 of the body 200 or onto the inner face of the wall 130*a*, and the other attaching portion 460 inserted is fixed onto the end face on the X'-direction side of the second portion 220 of the body 200 or onto the inner face of the wall 130*b*. Also, the one second elastic arms 440 inserted is brought into elastic contact with the inner face of the wall 130*a* from the X'-direction side, and the other second elastic arm 440 inserted is brought into elastic contact with the inner face of the wall 130*b* from the X-direction side. Upon the insertion of the attaching portions 460 and the second elastic arms 440, the second cover portion 430 is inserted between the walls 130*a* and 130*b*, and the second cover portion 430 is disposed so as to at least partly cover the second exposed portion 223 of the second portion 220 of the body 200 from the Y-direction side. Where the second portion 220 is provided with the housing recess 221, the second cover portion 430 is housed into the housing recess 221 from the Y-direction side so as to at least partly cover the second exposed portion 223.

(ii) Alternatively, where the shield cover 400 prepared includes the pair of attaching portions 460 of configuration (c) described above: It is preferable that the attaching portions 460 are inserted into the corresponding receiving holes in the second portion 220 of the body 200 when inserting the pair of second elastic arms 440.

(iii) Where the shield cover 400 includes the first cover portion 410 and the coupling portion 450 in addition to the second cover portion 430, the second elastic arms 440 of configuration (A), and the attaching portions 460 of one of configurations (a) to (c), but also: Upon insertion of the attaching portions 460 and the second elastic arms 440 as described above, the first cover portion 410 is inserted between the walls 130*a* and 130*b* so as to at least partly cover the first exposed portion 212*b* of the first portion 210 of the body 200 from the Z'-direction side.

(iv) Where the shield cover 400 includes the at least one first elastic arm 420 in addition to the second cover portion 430, the second elastic arms 440 of configuration (A), the attaching portions 460 of one of configurations (a) to (c), the first cover portion 410, and the coupling portion 450: when placing the first cover portion 410 so as to cover at least partly the first exposed portion 212*b* of the first portion 210 of the body 200, the at least one first elastic arm 420 is brought into elastic contact with at least one of the following portions of the shield case 100: the outer face of the tubular portion 110, the inner face of the wall 130*a*, and/or the inner face of the wall 130*b*.

The connector C described above provides at least the following technical features and effects.

(1) The connector C has improved EMC characteristics. The body 200 of the connector C is formed such that the first exposed portion 212*b* of the first portion 210 is exposed in the Z'-direction between the walls 130*a* and 130*b*, and that the second exposed portion 223 of the second portion 220 is exposed in the Y direction between the walls 130*a* and 130*b*. As such, where the shield case 100 of the connector C is made of a pressed metal plate, the shield case 100 by itself cannot cover the first exposed portion 212*b* nor the second exposed portion 223. This is because such covering would require modifying the shield case 100 such that parts of the walls 130*a* and 130*b* are cut and bent in order to cover the first exposed portion 212*b*, and that further parts of the walls 130*a* and 130*b* are cut and bent in order to also cover the second exposed portion 223, but such modifications would make it impossible to form the walls 130*a* and 130*b* having configurations as described above. On the other hand, the connector C obviates the need to partly cut and bend the walls 130*a* and 130*b*. More particularly, the connector C includes the shield cover 400 separately provided from the shield case 100, and the shield cover 400 includes at least one of the first cover portion 410 and the second cover portion 430. The first cover portion 410 can cover at least part of the first exposed portion 212*b* of the first portion 210 of the body 200 from the Z'-direction side, and/or the second cover portion 430 can cover at least part of the second exposed portion 223 of the second portion 220 of the body 200 from the Y-direction side. For the above reasons, it is possible to improve the EMC characteristics of the connector C.

(2) The connector C has improved communication characteristics, especially where the shield case 100 includes the tubular portion 110, the extended portion 120, the walls 130*a* and 130*b*, and the blocking portion 140, and where the shield cover 400 includes the first cover portion 410 and the second cover portion 430. This is because the shield case 100 and the shield cover 400 surround and cover the contact portion 310 and the lead portion 320 of the terminal 300 in a manner (2-1) or (2-2) as follows.

(2-1) Where the a portion on the Y-direction side of the contact portion 310 of the terminal 300 is disposed inside the tubular portion 110 of the shield case 100 and the portion on the Y'-direction side of the contact portion 310 and the lead portion 320 are disposed inside the extended portion 120 and between the walls 130*a* and 130*b* of the shield case 100, the shield case 100, the shield cover 400, and the terminal 300 are arranged as follows. The tubular portion 110 surrounds the portion on the Y-direction side of the contact portion 310 of the terminal 300; the extended portion 120 of the shield case 100 is disposed on the Z-direction side relative to the portion on the Y'-direction side of the contact portion 310 and the lead portion 320; the walls 130*a* and 130*b* of the shield case 100 are disposed respectively on the X- and X'-direction sides relative to the portion on the Y'-direction side of the contact portion 310 and the lead portion 320; the blocking portion 140 of the shield case 100 is disposed on the Y'-direction side relative to the lead portion 320; the first cover portion 410 of the shield cover 400 is disposed on the Z'-direction side relative to the portion on the Y'-direction side of the contact portion 310 of the terminal 300 and the horizontal portion of the lead portion 320; and the second cover portion 430 of the shield cover 400 is disposed on the Y-direction side relative to the vertical portion of the lead portion 320 of the contact portion 310 of the terminal 300.

(2-2) Where the entire contact portion 310 of the terminal 300 is disposed inside the tubular portion 110 of the shield case 100, and where the lead portion 320 of the terminal 300 is disposed inside the extended portion 120 and between the walls 130*a* and 130*b* of the shield case 100, the shield case 100, the shield cover 400, and the terminal 300 are arranged as follows. The tubular portion 110 of the shield case 100 surrounds the entire contact portion 310 of the terminal 300; the extended portion 120 of the shield case 100 is disposed on the Z-direction side relative to the lead portion 320; the walls 130*a* and 130*b* of the shield case 100 are disposed respectively on the X- and X'-direction sides relative to the lead portion 320; the blocking portion 140 of the shield case 100 is disposed on the Y'-direction side relative to the lead portion 320; the first cover portion 410 of the shield cover 400 is disposed on the Z'-direction side relative to the horizontal portion of the lead portion 320 of the terminal 300; and the second cover portion 430 of the shield cover 400 is disposed on the Y-direction side relative to the vertical portion of the lead portion 320 of the contact portion 310 of the terminal 300.

(3) The connector C serves to establish a stable grounding line, especially where the shield case 100 and the shield cover 400 are arranged as follows. Where the shield cover 400 includes the at least one first elastic arm 420 and/or the plurality of second elastic arms 440, the at least one first elastic arm 420 is in elastic contact with the tubular portion 110 of the shield case 100 and at least one of the walls 130*a* and 130*b*, and/or the second elastic arms 440 are in elastic contact with the walls 130*a* and 130*b* of the shield case 100. This arrangement stabilizes electrical conduction between the shield cover 400 and the shield case 100, so that the shield case 100 and the shield cover 400 serve to establish a stable ground line.

(4) The connector C is configured such that the shield cover 400 elastically contacts the shield case 100 in a manner (4-1) and/or (4-2) as follows.

(4-1) Where the shield cover 400 includes the first cover portion 410 and the at least one first elastic arm 420, the at least one first elastic arm 420 can be brought into elastic contact with the tubular portion 110 and at least one of the walls 130*a* and 130*b* when the first cover portion 410 is placed so as to cover at least part of the first exposed portion 212*b* of the first portion 210 of the body 200 (i.e. a portion of the body 200 on the Y'-direction side relative to the tubular portion 110).

(4-2) Where the shield cover 400 includes the second cover portion 430 and the plurality of second elastic arms 440, the second elastic arm 440 can be brought into elastic contact with the walls 130*a* and 130*b* of the shield case 100 when the second cover portion 430 is placed so as to cover at least part of the second exposed portion 223 of the second portion 220 of the body 200, between the walls 130*a* and 130*b*. Particularly where the second elastic arms 440 extends in the Y' direction from the second cover portion 430, when the second elastic arms 440 are respectively inserted between the second portion 220 of the body 200 and the walls 130*a* and 130*b*, the second cover portion 430 is placed so as to cover at least part of the second exposed portion 223 of the second portion 220 of the body 200. Where the plurality of attaching portions 460 as well as the second elastic arms 440 extend in the Y' direction from the second cover portion 430, when the second elastic arms 440 are respectively inserted between the second portion 220 of the body 200 and the walls 130*a* and 130*b* and the attaching portions 460 are respectively inserted between the second portion 220 of the body 200 and the walls 130*a* and 130*b* or into the receiving holes of the second portion 220 of the body 200, the second cover portion 430 is placed so as to cover at least part of the second exposed portion 223 of the second portion 220 of the body 200.

(5) Where the second portion 220 of the body 200 is provided with the housing recess 221, the second cover portion 430 of the shield cover 400 is housed in the housing recess 221. This arrangement eliminates or reduces the possibility that the shield cover 400 may become detached from between the walls 130*a* and 130*b*.

(6) The connector C is configured to be securely mounted on a circuit board for the following reason. The second portion 220 has a dimension in the Y-Y' direction smaller than that of each of the walls 130*a* and 130*b*. In other words, each of the walls 130*a* and 130*b* has a dimension in the Y-Y' direction larger than that of the second portion 220. This makes it possible to place the respective ends in the Z' direction of the walls 130*a* and 130*b* on the circuit board and thereby securely mount the connector C on the circuit board.

The connector of the invention is not limited to the embodiments and their variants described above, but may be modified within the scope of the accompanying claims. Specific modification examples will be described below.

The body of the invention may include the first exposed portion 212*b* of the first portion 210 and the second exposed portion 223 of the second portion 220 as described above, but either the first exposed portion 212*b* or the second exposed portion 223 may be omitted. To omit the first exposed portion 212*b*, the first exposed portion 212*b* of the first portion 210 may be covered by the tubular portion 110, setting the dimension in the Y-Y' direction of each of the walls 130*a* and 130*b* to be substantially the same as, or slightly larger than, the dimension in the Y-Y' direction of the second portion 220 of the body 200. In this case, it is preferable to omit the first cover portion 410 of the shield cover 400. To omit the second exposed portion 223, the second exposed portion 223 of the second portion 220 may be covered by a blocking portion that is contiguous with one of the walls 130*a* and 130*b* and bent at an angle of approximately 90° with respect to the wall 130*a* or 130*b*. In this case, it is preferable to omit the second cover portion 430 of the shield cover 400.

The shield case of the invention may not be made of a pressed metal plate. For example, the shield case may be made of a cast metal plate. The shield case of the invention may not include the extended portion. In such modified shield case, the tubular portion may preferable be contiguous with the pair of walls.

The connector according to any of the above aspects may be housed in an external body having insulating properties. At least a part of the external body may be covered with an external shield being electrically conductive. It should be appreciated that the invention does not require the external body and the external shield.

The invention only requires at least one second elastic arm and/or at least one attaching portion. For example, where there is provided a single second elastic arm 440 extending in Y-Y' direction, the second portion 220 of the body 200 may be provided with a single receiving groove to receive the second elastic arm 440. Alternatively, in place of the receiving groove, an interstice to receive the second elastic arm 440 may be provided between the wall 130*a* or 130*b* and the second portion 220 of the body 200. Where there is provided a single attaching portion 460 extending in Y-Y' direction, the second portion 220 of the body 200 may be provided with a single receiving groove or receiving hole to receive the attaching portion 460. Alternatively, in place of the receiving groove or receiving hole, an interstice to receive the attaching portion 460 may be provided between the wall 130*a* or 130*b* and the second portion 220 of the body 200.

The connector of the invention includes at least one terminal, which is only required to be held by an electrically insulating body and housed in the shield case of any of the above aspects. Where a plurality of terminals is provided, the terminals may be configured such that, for example, the terminals are held by an electrically insulating body, that the contact portions of the terminals are disposed in the tubular portion of the shield case of any of the above aspects, and that the lead portions of the terminals are disposed between the walls of the shield case of any of the above aspects.

The connector of the invention may or may not be mounted on a circuit board. For example, the connector of the invention may be a plug connector with at least one terminal connected to a cable. In this case, it is possible to omit the at least one leg portion of the shield case.

It should be appreciated that the materials, the shapes, the dimensions, the number, the positions, etc. of the elements of the connector in the above-described embodiments and their variants are presented by way of example only and can be modified in any manner as long as the same functions can be fulfilled. The aspects and variants of the above-described embodiments can be combined in any possible manner. It should be noted that the first direction of the invention may be any direction in which the tubular portion of the shield case of the invention extends. The second direction of the invention may be any direction crossing the first direction. The third direction of the invention may be any direction crossing the first and second directions.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

C: connector
100: shield case
110: tubular portion
120: extended portion
121: first end
122: second end
130*a*, 130*b*: wall
131*a*, 131*b*: leg portion
132*a*, 132*b*: engaging portion
140: blocking portion
141*a*, 141*b*: engaging portion
150: contact portion
200: body
210: first portion
211: distal portion
211*a*: connection hole
212: basal portion
212*a*: lock groove
212*b*: first exposed portion
213: intermediate portion
213*a*: lock hole
220: second portion
221: housing recess
222*a*, 222*b*: receiving groove
223: second exposed portion
230: housing groove
300: terminal
310: contact portion
320: lead portion
330: tail
400: shield cover
410: first cover portion
420: first elastic arm
430: second cover portion
440: second elastic arm
450: coupling portion
460: attaching portion

What is claimed is:

1. A connector comprising:

a shield case being electrically conductive and including:

a tubular portion extending in a first direction; and a pair of walls on one side in the first direction relative to the tubular portion, the walls facing each other in a second direction and extending to one side in a third direction, the first direction being an axial direction of the tubular portion, the second direction being substantially orthogonal to the first direction, and the third direction crossing the first and second directions;

a body being electrically insulating, being housed in the shield case, and including:

a first portion extending in the first direction, being disposed in the tubular portion, and including a basal portion positioned on the one side in the first direction relative to the tubular portion, the basal portion including a first exposed portion exposed in the third direction between the walls, and a second portion extending to one side in the third direction from the basal portion of the first portion and being disposed between the walls of the shield case;

at least one terminal held by the body and housed in the shield case; and a shield cover being electrically conductive, being provided separately from the shield case, and including a first cover portion, the first cover portion being disposed between the walls and covering at least part of the first exposed portion of the first portion of the body from the one side in the third direction.

2. The connector according to claim 1, wherein the shield cover further includes at least one first elastic arm provided at the first cover portion, and the at least one first elastic arm is in elastic contact with at least one of the tubular portion, one of the walls, or the other wall of the shield case.

3. The connector according to claim 1, wherein the second portion of the body further includes a second exposed portion exposed in the first direction between the walls, and the shield cover further includes a second cover portion, the second cover portion being disposed between the walls and covering at least part of the second exposed portion of the second portion of the body from the other side in the first direction.

4. The connector according to claim 3, wherein the shield cover further includes a coupling portion to couple the first cover portion to the second cover portion.

5. The connector according to claim 1, wherein the shield cover further includes at least one attaching portion located between the walls of the shield case, and each attaching portion of the at least one attaching portion is attached to the second portion of the body and/or one of the walls.

6. The connector according to claim 5, wherein each attaching portion of the at least one attaching portion extends in the first direction and is inserted between the second portion and one of the walls.

7. The connector according to claim 5, wherein the at least one attaching portion extends in the first direction, is received in a receiving groove or a receiving hole provided in the second portion of the body, and is attached to the second portion.

8. The connector according to claim 1, wherein each of the walls is larger in dimension in the first direction than the second portion of the body.

9. The connector according to claim 1, wherein the tubular portion of the shield case has a first end on one side in the first direction, the shield case further includes an extended portion and a blocking portion, the extended portion being shaped like a half tube having a generally semi-circular, generally semi-polygonal, generally arc-shaped, or generally U-shaped, cross-section taken along the third direction, the extended portion of the shield case extends to the one side in the first direction from a portion on the other side in the third direction of the first end of the tubular portion and includes first and second ends respectively on one and the other sides in the second direction, the walls of the shield case comprise a first wall and a second wall, the first wall extends from the first end of the extended portion to the one side in the third direction, the second wall extends from the second end of the extended portion to the one side in the third direction, and the blocking portion at least partly blocks a space inside the extended portion and a space between the first and second walls from the one side in the first direction.

10. A connector comprising:

a shield case being electrically conductive and including:

a tubular portion extending in a first direction; and a pair of walls on one side in the first direction relative to the tubular portion, the walls facing each other in a second direction and extending to one side in a third direction, the first direction being an axial direction of the tubular portion, the second direction being substantially orthogonal to the first direction, and the third direction crossing the first and second directions;

a body being electrically insulating, being housed in the shield case, and including:

a first portion extending in the first direction, being disposed in the tubular portion, and including a basal portion positioned on the one side in the first direction relative to the tubular portion, and a second portion extending to one side in the third direction from the basal portion of the first portion, being disposed between the walls of the shield case, and including a second exposed portion exposed in the first direction between the walls;

at least one terminal held by the body and housed in the shield case; and a shield cover being electrically conductive, being provided separately from the shield case, and including a second cover portion, the second cover portion being disposed between the walls and covering at least part of the second exposed portion of the second portion of the body from the other side in the first direction.

11. The connector according to claim 10, wherein the shield cover further includes at least one second elastic arm provided at the second cover portion, and each second elastic arm of the at least one second elastic arm is in elastic contact with one of the walls.

12. The connector according to claim 11, wherein the pair of walls comprises a first wall and a second wall, the at least one second elastic arm comprises a plurality of second elastic arms including one second elastic arm and the other second elastic arm, the one second elastic arm is inserted between the first wall and the second portion of the body, and the other second elastic arm is inserted between the second wall and the second portion of the body.

13. The connector according to claim 12, wherein the second portion of the body is provided with a housing recess opening to the other side in the first direction and housing the second cover portion, and the second exposed portion of the second portion is a bottom of the housing recess.

14. The connector according to claim 11, wherein the second portion of the body is provided with a housing recess opening to the other side in the first direction and housing the second cover portion, and the second exposed portion of the second portion is a bottom of the housing recess.

15. The connector according to claim 10, wherein the second portion of the body is provided with a housing recess opening to the other side in the first direction and housing the second cover portion, and the second exposed portion of the second portion is a bottom of the housing recess.

16. The connector according to claim 10, wherein the shield cover further includes at least one attaching portion located between the walls of the shield case, and each attaching portion of the at least one attaching portion is attached to the second portion of the body and/or one of the walls.

17. The connector according to claim 16, wherein each attaching portion of the at least one attaching portion extends in the first direction and is inserted between the second portion and one of the walls.

18. The connector according to claim 16, wherein the at least one attaching portion extends in the first direction, is received in a receiving groove or a receiving hole provided in the second portion of the body, and is attached to the second portion.

19. The connector according to claim 10, wherein each of the walls is larger in dimension in the first direction than the second portion of the body.

20. The connector according to claim 10, wherein the tubular portion of the shield case has a first end on one side in the first direction, the shield case further includes an extended portion and a blocking portion, the extended portion being shaped like a half tube having a generally semi-circular, generally semi-polygonal, generally arc-shaped, or generally U-shaped, cross-section taken along the third direction, the extended portion of the shield case extends to the one side in the first direction from a portion on the other side in the third direction of the first end of the tubular portion and includes first and second ends respectively on one and the other sides in the second direction, the walls of the shield case comprise a first wall and a second wall, the first wall extends from the first end of the extended portion to the one side in the third direction, the second wall extends from the second end of the extended portion to the one side in the third direction, and the blocking portion at least partly blocks a space inside the extended portion and a space between the first and second walls from the one side in the first direction.

* * * * *